US007249553B1

(12) United States Patent
Gaudre et al.

(10) Patent No.: US 7,249,553 B1
(45) Date of Patent: Jul. 31, 2007

(54) PROCESS AND PLANT FOR DESTROYING SOLID-PROPELLANT ROCKET MOTORS

(75) Inventors: Marie Gaudre, Le Haillan (FR); Eric Marchand, St. Medard en Jalles (FR); Jean-Michel Tauzia, Blanquefort (FR); Jean-Louis Trichard, St. Medard en Jalles (FR)

(73) Assignee: SNPE Materiaux Energetiques, Paris (FR)

( * ) Notice: Subject to any disclaimer, the term of this patent is extended or adjusted under 35 U.S.C. 154(b) by 357 days.

(21) Appl. No.: 10/855,322

(22) Filed: May 28, 2004

(30) Foreign Application Priority Data

Jul. 10, 2003 (FR) ..... 03 08474

(51) Int. Cl.
*F42B 33/06* (2006.01)

(52) U.S. Cl. ..... 86/50; 588/403

(58) Field of Classification Search ..... 86/50; 149/124; 588/403
See application file for complete search history.

(56) References Cited

U.S. PATENT DOCUMENTS

| | | | | |
|---|---|---|---|---|
| 3,075,461 A | | 1/1963 | Ehlmann | |
| 3,440,096 A | | 4/1969 | Scott | |
| 4,376,666 A | * | 3/1983 | Williams, Jr. | 149/109.6 |
| 4,854,982 A | * | 8/1989 | Melvin et al. | 149/109.6 |
| 4,909,868 A | * | 3/1990 | Melvin | 149/109.6 |
| 5,025,632 A | * | 6/1991 | Spritzer | 62/64 |
| 5,220,107 A | * | 6/1993 | Kubacki | 588/320 |
| 5,284,995 A | * | 2/1994 | Melvin | 588/313 |
| 5,331,106 A | * | 7/1994 | Spas | 423/130 |
| 5,430,229 A | * | 7/1995 | Voss | 588/319 |
| 5,501,132 A | * | 3/1996 | de Nevers et al. | 86/24 |
| 5,524,545 A | * | 6/1996 | Miller et al. | 102/293 |
| 5,552,093 A | | 9/1996 | Lee | |
| 5,941,466 A | * | 8/1999 | Alba et al. | 241/1 |
| 6,245,958 B1 | | 6/2001 | Morse et al. | |

FOREIGN PATENT DOCUMENTS

| | | | |
|---|---|---|---|
| DE | 3447647 C | * | 5/1986 |
| FR | 1 358 860 A | | 4/1964 |
| JP | 2002048499 A | * | 2/2002 |
| RU | 2143660 C1 | * | 12/1999 |

OTHER PUBLICATIONS

English translation of RU 2143660 C1, Dec. 1999, Russia, Borozdin et al.*
English translation of JP 2002048499 A, Feb. 2002, Japan, Funahashi et al.*

* cited by examiner

*Primary Examiner*—James S. Bergin
(74) *Attorney, Agent, or Firm*—Oliff & Berridge, PLC

(57) ABSTRACT

Described is a process and a plant for destroying rocket motors, including in particular the following steps and stations: cutting of the motor into sections; cooling of the sections containing propellant by immersion in a cryogenic liquid; and fragmenting and extraction of the cooled propellant by elastic deformation of the casing of the section. The propellant fragments are recovered for subsequent treatment and the casings are deactivated before being scrapped.

17 Claims, 2 Drawing Sheets

PROCESS AND PLANT FOR DESTROYING SOLID-PROPELLANT ROCKET MOTORS

BACKGROUND

The present invention relates to the field of solid-propellant rocket motors. It relates more particularly to the destruction of reformed rocket motors, especially those that have reached the limit of their operational use and have been removed from service.

A solid-propellant rocket motor essentially comprises a hollow cylindrical casing inside which is placed at least one block of solid propellant—to simplify matters we will refer hereafter to one block of propellant. One end of the casing is closed off by a dome and the opposite end by a nozzle; the dome and the nozzle will be regarded as forming part of the casing.

The rocket motors considered here are those for which the block of solid propellant has been fastened to the casing and cannot be removed simply from the casing. These are essentially what are called "cast-bonded" motors for which the block of propellant, during manufacture of the motor, is cast in and bonded to the casing suitably prepared for this purpose. We shall liken to this type of motor those for which the block of propellant, prepared elsewhere, is introduced and fitted irreversibly into the casing, this fitting operation being intentional or accidental. We shall retain the expression "cast-bonded" rocket motors to denote the motors treated in this invention.

The destruction of a rocket motor consists firstly in placing it in a state such that it cannot fulfil its propulsion function and then secondly in separating the casing from the propellant in order to treat them separately, taking into account the fact that only the propellant involves a pyrotechnic risk, which requires special precautions and conditions in its treatment for the purpose of scrapping or recycling certain components.

The problem more particularly tackled here is that of how to destroy a very large number, typically several thousand, of rocket motors; it is necessary to be able to treat several tens of motors per day.

Both the destruction process and the destruction plant must be capable of operating at a very high rate. What is therefore required is a process with simple and rapid steps and an unsophisticated plant.

In addition, the process and the plant must be reliable. An incident occurring on a motor or part of a motor during one step of the process must remain limited, or be able to be limited, to this part of the motor, and to the location in the plant where the said incident occurs. The incident must not propagate throughout the plant and become catastrophic, owing to the large number of motors necessarily present on the destruction site.

The prior art discloses several processes for destroying rocket motors, but under conditions which do not correspond to the problem posed, as we will see during the course of analysing these processes.

U.S. Pat. No. 5,220,107 discloses the fragmentation of a block of bare propellant, that is to say one not bonded to the inside of the casing of a rocket motor, by cooling the block of propellant down to a very low temperature and by using a crusher or a press to fragment it.

U.S. Pat. No. 5,025,632 discloses the extraction of the propellant from a cast-bonded rocket motor with a central channel using at least one jet of cryogenic liquid. This destruction process, derived from a "water knife", is very lengthy and does not meet the requirement for a high work rate. In addition, it is potentially hazardous as the work is carried out on an entire rocket engine.

U.S. Pat. No. 5,552,093 discloses the extraction of the propellant from a cast-bonded rocket motor that has been cooled by immersion in liquid nitrogen. The block of propellant is fragmented, especially by applying mechanical shocks to it. The application of shocks to the propellant, even when cooled, is still potentially hazardous, and this hazard is greater owing to the fact that, here again, the work is carried out on an entire motor. In addition, for relatively long motors, the possibility of fragments becoming jammed in the casing, and requiring further handling operations to extract them from the casing, cannot be ruled out.

SUMMARY

The present invention aims to solve the difficulties that these various processes do not take into consideration when it is necessary to devise a destruction process to be carried out at a very high rate, and to do so without unreasonably increasing the number of plants operating in parallel in order to destroy a large number of rocket motors.

According to the invention, the process for destroying a solid-propellant rocket motor comprises the following steps:

- the motor is cut up into sections perpendicular to the axis of the motor;
- the sections not containing propellant are withdrawn from the rest of the sequence;
- the sections containing propellant are cooled to a temperature very much below the glass transition temperature range of the propellant binder;
- the propellant is separated from the casing of each section, i.e. the section is thus emptied of the propellant that it contained;
- the empty casing sections are recovered for a supplementary step of deactivating any propellant residues; and
- the fragmented propellant is recovered for subsequent treatment.

EMBODIMENTS

Figure 1A:
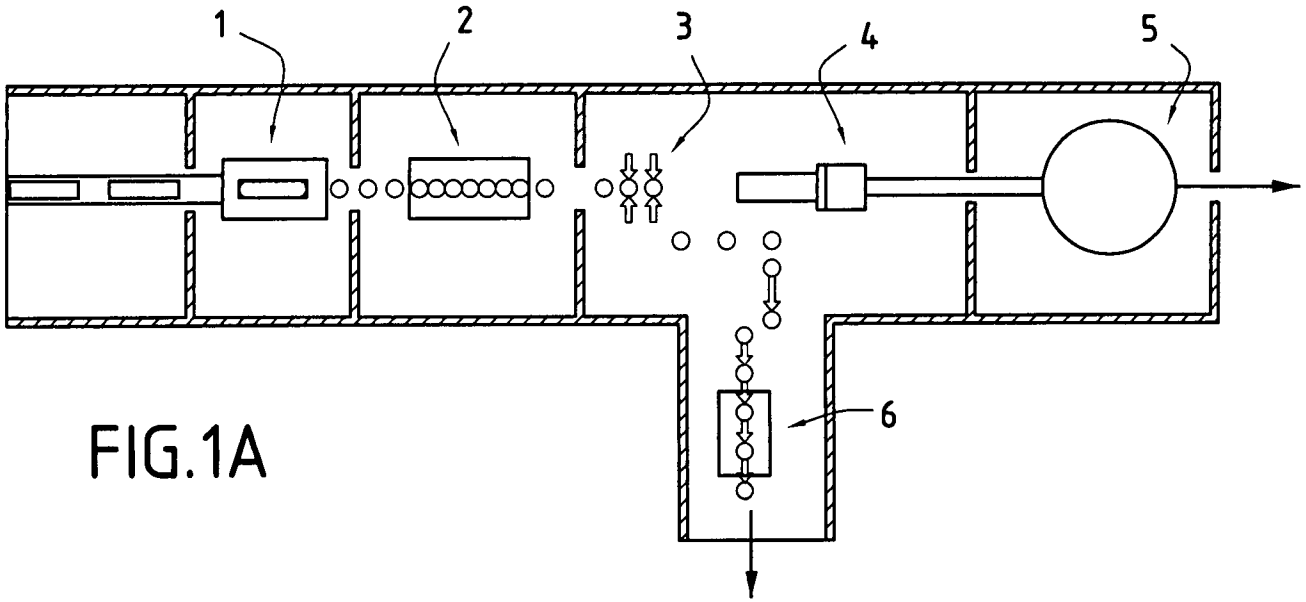
FIG. 1A illustrates schematically a plan view of a plant for implementing a process in accordance with embodiments of the present disclosure.
Figure 1B:
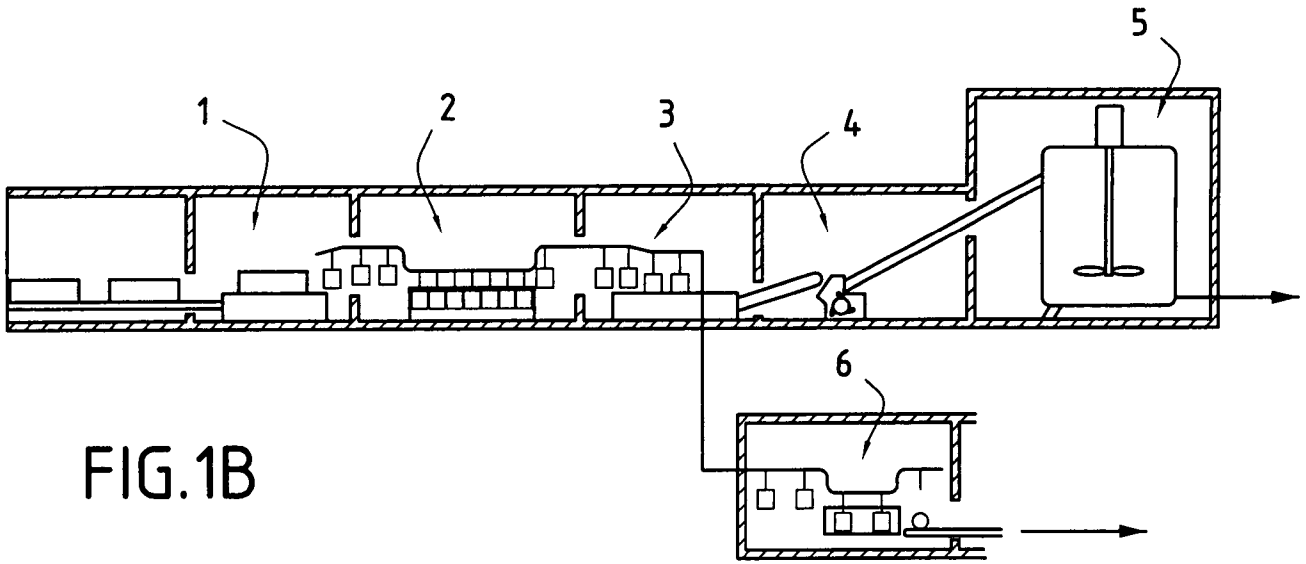
FIG. 1B illustrates schematically a side view of a plant for implementing a process in accordance with embodiments of the present disclosure.

The present process therefore relates to solid-propellant rocket motors for which the block of propellant is fastened to the casing; the motors involved in this process do not include an ignition device—this is disconnected and removed from the motor in a preparatory operation before the motors are delivered to the destruction site. The rocket motor casing is either entirely made of metal or a composite material. The block of propellant has a central channel extending over its entire length or only part of it. In the latter case, that portion on the side away from the nozzle does not have a channel. The block of propellant may possibly be a end burning block, that is to say it does not have a central channel.

The cut-up sections of the motor are of two types:

sections without propellant: in general, there is only one section of this type per motor. This section carries all or part of the nozzle and it contains no pyrotechnic material; this type of section is removed from the present sequence; and sections with propellant: the cut-up portion of the block remains bonded to the cut-up portion of the casing; this type of section will undergo the other steps of the process. At least one of the ends of the section is wide open, i.e. the diameter of the opening is approximately equal to the motor calibre.

Advantageously, the sections containing propellant have a section length "l"/section outside diameter "d" ratio of less than or equal to 2.5 (i.e. $l/d \leqq 2.5$).

All the methods known for cutting up rocket motors into sections may be used. However, owing to the need for a high operating rate and also the safety requirements, it will be advantageous to employ methods using at least one jet of high-pressure liquid to which suitable abrasive substances may optionally be added.

Preferably, to increase the efficiency of the operation, the process uses several jets placed in parallel and prepositioned relative to the motor in order to cut it up into the various sections in a single operation.

Also preferably, in order to increase safety, for cutting up the motor the latter is immersed in the same liquid as that used for the jets; usually the liquid used is water.

The liquid and the casing and propellant chips resulting from the cutting operations are periodically removed for the purpose of suitable treatments.

The sections containing propellant are, using appropriate handling means, transported and immersed in a bath of a cryogenic liquid that is inert with respect to the section components. In general, the cryogenic liquid used is liquid nitrogen.

The sections are immersed for a time long enough for the casing and the propellant to be cooled quite substantially and for the differential contractions between casing and propellant to create tensile stresses that crack the propellant and also debond it from the casing.

Typically, the intended final temperature for the motor section is at least 20° C. below the glass transition temperature range of the propellant binder. Advantageously, the intended temperature is between about −100° C. and about −80° C. for both the propellant and the casing.

The sufficiently cooled sections are then sent to a station for extracting the propellant, which has been embrittled by the cold. The propellant is extracted by making the casing undergo slight deformation. Such deformation remains within the elastic range of deformation of the casing at this temperature. The propellant breaks up into rather coarse fragments, typically of the size of a clenched fist.

The section is placed with its axis vertical and the propellant fragments drop out under gravity and are recovered either on a conveyor belt or in a receptacle containing water in order to make the propellant fragments inert. Since the motor section has a relatively short length compared with its diameter, i.e. $l/d \leqq 2.5$, the propellant fragments do not become jammed in the casing.

According to a first variant, the cooled motor section, with its axis vertical and its larger-diameter opening directed downwards, is placed between a stop and a jack head. The axis of the jack is horizontal and perpendicular to the axis of the motor section. The displacement of the jack head is calculated so that the deformation of the casing remains within its elastic deformation range.

According to another variant, the cooled motor section is driven between two rolls forming a rolling mill. These rolls are suitably spaced apart in order to impose, here again, a deformation that remains within the elastic deformation range of the casing. The rolls drive the motor section and deform it slightly, from the bottom of the said section up to its top, thereby making it easier to extract the propellant fragments by gravity.

The empty casing section possibly has a few thin residual traces of propellant that have remained bonded at certain points inside the casing. The empty section is recovered in order to undergo a subsequent step of deactivating such residues.

Advantageously, this deactivation is carried out in a closed chamber comprising burners whose flames burn off the traces of propellant. The flue gases are collected and scrubbed with water—no gaseous effluent is therefore discharged into the atmosphere. The scrubbing water is collected in order to be treated and decontaminated using known processes.

Preferably, when the oxidizing charge of the propellant is soluble in a liquid, the deactivation of any propellant residues adhering to the inside of the casing is carried out by immersing the empty casing section in the said liquid. When the oxidizing charge has dissolved in the liquid, there then remain, on the inside wall of the casing, only bits of matrix consisting of binder and combustible charge of no pyrotechnic hazard. The rate of diffusion of the oxidizing charge and of its dissolution in the liquid is advantageously speeded up by heating the liquid. The liquid containing the oxidizing charge in solution is recovered for subsequent treatment by known processes. Frequently, the oxidizing charge is ammonium perchlorate and the liquid used for dissolving it is water.

Having many rocket motors to be destroyed, it may seem paradoxical to increase the number of objects to be treated by cutting a motor up into sections.

From the safety standpoint, the sections without propellant, which do not entail any pyrotechnic risk, are removed from the sequence of operations. A section containing propellant is very short and will not be propulsive in the event of accidental ignition. It will not undergo any random and inopportune displacement that can make the incident propagate to any other station. However, precautions must be taken as regards thermal effects.

From the standpoint of efficiency, this cutting-into-sections operation contributes to the efficiency of the following steps of the process:

the sections are cooled more rapidly than an entire motor because of a lower mass and a larger area for heat exchange with the cryogenic liquid;

since the sections are short, the fragments drop out by gravity and do not run the risk of becoming jammed, as exists in a complete rocket motor; and the deactivation of the propellant residues carried out on empty casing sections is easier than that carried out on the complete casing of a motor, and this is so whatever the process adopted.

The propellant fragments obtained after elastic deformation of the casing are in general rather coarse, namely a few centimeters or about the size of a clenched fist. Before passing to the next step of the propellant treatment, it is necessary to carry out finer milling of the said fragments so as to obtain particles of propellant, the particles having dimensions of the order of at most a centimeter and preferably a few millimeters.

This milling may be carried out in various ways, but preferably knife mills are used, the milling advantageously being carried out under a water spray.

The next step in the treatment of the propellant, thus particulated, is the dissolution of the oxidizing charge in a suitable liquid, for example water when the oxidizing charge is a perchlorate.

To increase the rate of dissolution, the latter is preferably carried out in a well-stirred and thermally regulated reactor.

The liquid that contains the oxidizing charge in solution is separated from the solid residue; the latter comprises the binder and the optional combustible charge—there is no pyrotechnic risk. The solid residue is either directly discharged into a technical burial centre or is reutilized in order to extract the metallic combustible charge therefrom after conventional known treatments for industrial waste.

The liquid is either treated by biodegradation processes, such as those described in patent FR 2 788 055 or its corresponding U.S. Pat. No. 6,328,891, in order to degrade the oxidizing charge, or treated in order to reutilize the said oxidizing charge and to recrystallize it by known processes.

The invention will be explained in further detail below by means of figures that show a plant for carrying out the process.

The rocket motors are brought into a storage area, identified, for traceability of the operation, placed one by one on a conveyor, and introduced one by one into the plant via a first airlock.

In the cutting station 1, the motor is immersed in a tank containing water and positioned on a rig that rotates relative to a suitably placed spray rail delivering several high-pressure jets and the motor is cut up into sections. High-pressure spray rails are produced with standard equipment, for example Digital Control equipment, delivering high-pressure jets, the pressure being about 300 MPa, by means of two pumps. In general, there will be one section that does not contain propellant but a large part of the nozzle; this section containing no pyrotechnic substance is removed from the sequence.

The other sections 10 of the motor are taken up by another conveyor and carried, through an airlock, into the cooling station 2 where they are cooled by immersion in the cryogenic liquid. This station essentially comprises a long bath in which several sections suitably spaced apart are immersed. The sections are moved along as the process takes place and they therefore remain a long time in the liquid, thereby cooling them down to temperatures of about −100° C.

The sections are directed, one by one, via another airlock, to the fragmentation station 3 where the propellant bonded to the casing section is fragmented. An example of a device is illustrated in greater detail in FIG. 2.

In this station, the suitably oriented section is deformed by compressing the casing. The propellant, embrittled and cracked by the cooling, fragments. The fragments are recovered for subsequent treatment.

The casing sections emptied of propellant are directed to a residue deactivation station 6. In this example, the deactivation of the sections is carried out by immersing the said sections in a tank containing water.

The propellant fragments are directed to a fine milling station 4 using knife mills with water spray. Standard high-performance machines, with a few safety modifications, can treat up to 1000 kg of propellant per hour.

The particles obtained after fine milling are introduced, in the dissolution station 5, into a reactor of large volume, the said reactor being well stirred and thermally regulated in order to increase the rate at which the oxidizing charge dissolves in the water.

In this diagram, all the various handling means have not been shown in detail, nor have the devices for opening and closing the airlocks of the plant, nor the services for each work station.

Figure 2B:
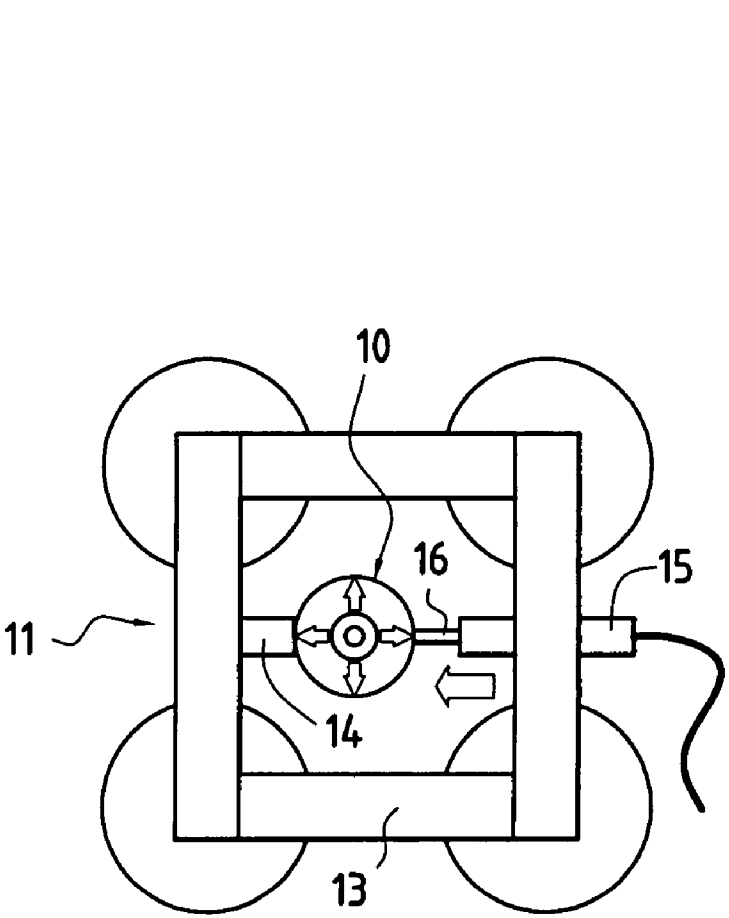
FIG. 2B illustrates schematically a plan view of an apparatus for extracting a propellant in accordance with embodiments of the present disclosure.
Figure 2A:
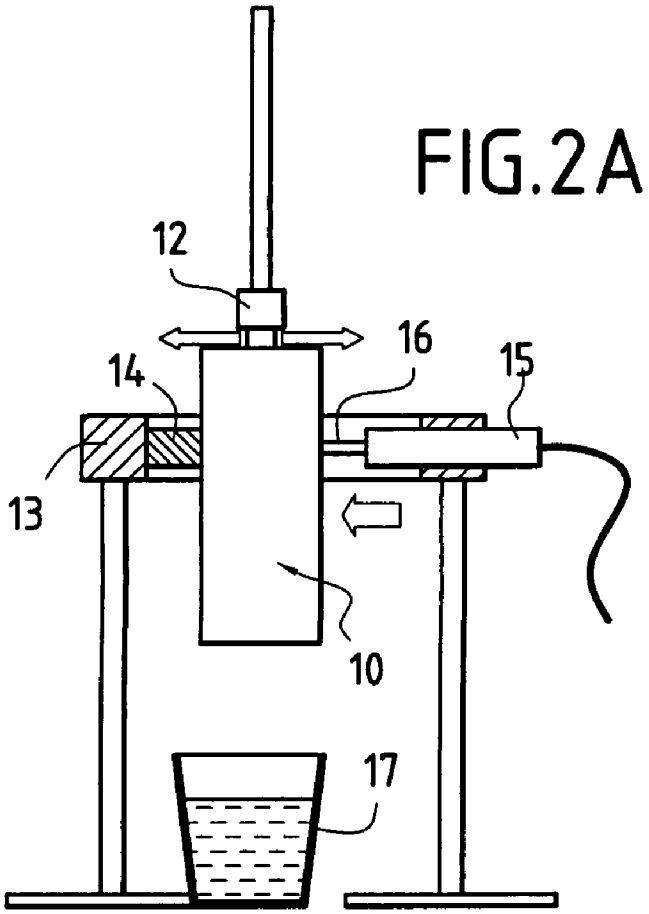
FIG. 2A illustrates schematically a side view of an apparatus for extracting a propellant in accordance with embodiments of the present disclosure.

FIG. 2*a*) shows schematically a side view and FIG. 2*b*) a plan view of an apparatus 11 for extracting the propellant from a cooled rocket motor section 10.

The apparatus essentially comprises a rectangular stand 13, anchored on four feet, with a stop 14 on one of the sides of the stand and a hydropneumatic jack 15 fastened on the opposite side, the jack being placed horizontally.

The rocket motor section 10 to be treated is held, with its axis vertical, by a handling means shown schematically by the reference 12. The said handling means brings the motor section 10 between the stop 14 and the jack rod 16.

The jack rod 16 bears on the casing of the motor section approximately one third the way along its length starting from the bottom of the section. The displacement of the jack rod 16 is defined in order to subject the casing to a deformation which remains within the elastic deformation range of the latter, to fragment the cold propellant and to separate it from the casing.

A receptacle 17, containing water in order to make the propellant fragments that drop simply under gravity inert, is placed beneath the motor section, the said receptacle 17 being shown only in FIG. 2*a*).

This apparatus is placed in a suitable room with entry and exit airlocks and all the services needed for remote-controlled operation.

The invention claimed is:

1. A process for destroying a solid-propellant rocket motor of a cast-bonded type, the motor having an axis, a casing, and a block of propellant including a binder, comprising:

cutting up the motor into sections perpendicular to the axis;

withdrawing sections not containing the propellant;

cooling sections containing the propellant to a temperature of at least about 20° C. below a glass transition temperature range of the propellant binder;

fragmenting the propellant and separating the propellant from the casing of each section containing the propellant by elastic deformation of the casing, thereby emptying the casing of the propellant;

recovering the emptied casing sections;

deactivating propellant residues of the empty casing sections; and recovering the fragmented propellant for a subsequent treatment.

2. The process of claim 1, wherein the sections containing propellant have a length/outside diameter ratio of less than or equal to 2.5.

3. The process of claim 2, wherein the motor is cut up by at least one high-pressure liquid jet.

4. The process of claim 2, wherein the sections containing propellant are cooled by immersion in a cryogenic liquid.

5. The process of claim 1, wherein the motor is cut up by at least one high-pressure liquid jet.

6. The process of claim 5, wherein, for cutting up the motor, the latter is immersed in a tank containing the same liquid as that used for supplying a spray rail delivering several jets that are prepositioned relative to the motor.

7. The process of claim 1, wherein the sections containing propellant are cooled by immersion in a cryogenic liquid.

8. The process of claim 7, wherein the cryogenic liquid is liquid nitrogen.

9. The process of claim 7, wherein the sections containing propellant are cooled to a temperature between about −100° C. and about −80° C.

10. The process of claim 7, wherein each empty section is deactivated by burning off traces of propellant residues, with recovery and scrubbing of flue gases.

11. The process of claim 7, wherein each empty section is deactivated by immersing the section in a liquid that dissolves the oxidizing charge.

12. The process of claim 1, wherein one or more fragments of propellant are collected in a receptacle.

13. The process of claim 1, wherein the elastic deformation is carried out on the casing of each cooled section with the axis of the cooled section being vertical.

14. The process of claim 13, wherein the axis of the casing of the cooled section is held vertical by a jack having its axis horizontal.

15. The process of claim 14, wherein the jack is a hydro pneumatic jack.

16. The process of claim 14, wherein the jack bears on the casing about one third along a length of the casing starting from the bottom of the cooled casing section.

17. The process of claim 1, wherein the elastic deformation is carried out by driving the casing of each cooled section between two rolls forming a rolling mill.

* * * * *